US010112228B2

(12) United States Patent
Baker et al.

(10) Patent No.: US 10,112,228 B2
(45) Date of Patent: Oct. 30, 2018

(54) BOTTOM EXPANSION STATION

(71) Applicant: Silgan Containers LLC, Woodland Hills, CA (US)

(72) Inventors: Gerald J. Baker, Wauwatosa, WI (US); Michael Patrick Moore, Hartford, WI (US)

(73) Assignee: Silgan Containers LLC, Woodlands Hills, CA (US)

( * ) Notice: Subject to any disclaimer, the term of this patent is extended or adjusted under 35 U.S.C. 154(b) by 136 days.

(21) Appl. No.: 15/231,993

(22) Filed: Aug. 9, 2016

(65) Prior Publication Data

US 2016/0346825 A1 Dec. 1, 2016

Related U.S. Application Data

(63) Continuation of application No. PCT/US2014/017404, filed on Feb. 20, 2014.

(51) Int. Cl.

| | |
|---|---|
| ***B21D 26/02*** | (2011.01) |
| ***B21D 26/021*** | (2011.01) |
| ***B21D 24/04*** | (2006.01) |

(52) U.S. Cl.

CPC ..... *B21D 26/021* (2013.01); *B21D 24/04* (2013.01)

(58) Field of Classification Search

CPC .... B21D 22/30; B21D 26/021; B21D 26/033; B21D 26/049; B21D 51/2607; B21D 51/2669

See application file for complete search history.

(56) References Cited

U.S. PATENT DOCUMENTS

| | | | | |
|---|---|---|---|---|
| 5,056,350 | A | 10/1991 | Moen et al. | |
| 7,007,531 | B2 | 3/2006 | Donhauser et al. | |
| 7,107,804 | B2 | 9/2006 | Gong et al. | |
| 2005/0044921 | A1 | 3/2005 | McClung | |
| 2011/0167886 | A1 | 7/2011 | Mallory et al. | |
| 2015/0101380 | A1* | 4/2015 | Cook | B21D 51/2669 72/58 |

FOREIGN PATENT DOCUMENTS

WO WO 2015-126401 8/2015

OTHER PUBLICATIONS

International Search Report and Written Opinion regarding PCT/US2014/017404, dated Nov. 20, 2014, 13 pages.

"Production of Two-Piece Drink and Preserved Food Cans: Processes, Equipment, Plant Layout", Werkstat und Betrieb, col. 112, No. 3, Mar. 1979, 9 pages.

(Continued)

*Primary Examiner* — Debra Sullivan

(74) *Attorney, Agent, or Firm* — Reinhart Boerner Van Deuren S.C.

(57) ABSTRACT

A bottom expansion station is provided. The station provides a blank support, a punch having a central recess configured to punch a blank through the blank support forming a cup, and a pressure exertion medium including a material through which pressure is exerted on a portion the end wall of the cup to increase the area of the end wall. The material is configured to be deformed by the end wall when pressure is exerted through it on the portion of the end wall.

11 Claims, 11 Drawing Sheets

(56) References Cited

OTHER PUBLICATIONS

"A critical review of the current end-coining practices for container end closures", Journal of Material Shaping Technology, vol. 7, No. 2, 1989, 16 pages.
"Essential Activities Leading to a Reduction in Material Costs for a 12-oz. DWI Container of Tinplate", Third International Tinplate Conference, Oct. 1984, 10 pages.
"New Developments in Producing Tin Plate and Cans", Metall, col. 41, No. 9, 8 pages.
"Optimising the variables when deep-drawing C.R.1 cups", Journal of Materials Processing Technology, vol. 136, No. 1-3; pp. 64-71; May 10, 2003, 10 pages.
"Thin Walled Steel Containers", Sheet Steel Technology conference, Mar. 5-9, 1984, 12 pages.
"Deep drawing of food cans from double-reduced, surface-treated steel sheet", Blech Rohre Profile, vol. 34, No. 9, Sep. 1987, 5 pages.
"An analysis of ironing limit in sheet metal forming", Key Engineering Materials, vol. 183-187, No. 1, 2000, 8 pages.
"Effects of material anisotropy on drawing of thin wall containers", Journal of Hefei University of Technology (Natural Science), vol. 30, No. 11, Nov. 2007, 5 pages.
"Fundamentals of Modern Can Making and Materials Development for Two-piece Can Manufacturing", Transactions ISU, col. 28, 1988, 6 pages.

* cited by examiner

BOTTOM EXPANSION STATION

CROSS REFERENCE TO RELATED PATENT APPLICATIONS

This application claims priority to and the benefit of PCT Application Number PCT/US14/17404 filed Feb. 20, 2014 which is incorporated herein by reference in its entirety.

BACKGROUND OF THE INVENTION

The present invention relates generally to the field of can-making machines and more specifically to can-making machines with stations configured to apply pressure to end walls to thin the end walls.

SUMMARY OF THE INVENTION

One embodiment of the invention relates to a bottom expansion station. The bottom expansion station includes a blank support configured to support a blank. The blank support defines a central aperture. The bottom expansion station includes a punch configured to draw the blank through the central aperture of the blank support to a form a cup having a sidewall and an end wall. The punch includes an aperture. The bottom expansion station includes a pressure exertion medium. The pressure exertion medium has a surface which contacts the end wall to apply pressure on a portion of the end wall to move the portion of the end wall through the aperture of the punch. The pressure exertion medium is deformable in shear mode under a first amount of force. The end wall of the cup is slidable relative to the surface of the pressure exertion medium with a second amount of force which is greater than the first amount of force.

Another embodiment of the invention relates to a bottom expansion station. The bottom expansion station includes a blank support configured to support a blank. The blank support defines a central aperture having an aperture area. The bottom expansion station includes a punch configured to draw the blank through the central aperture of the blank support to form a cup having a sidewall and an end wall. The punch includes an aperture providing access to a cavity. The cavity has a greater surface area than the aperture. The bottom expansion station includes a pressure exertion medium through which pressure is exerted on a portion of the end wall of the cup to increase the area of the end wall. The pressure exertion medium is configured to exert pressure on an area of the end wall at least 50% of the aperture area generally at the initiation of exerting pressure on the end wall.

Another embodiment of the invention relates to a bottom expansion station. The bottom expansion station includes a blank support configured to support a blank. The blank support defines a central aperture having an aperture area. The bottom expansion station includes a punch. The punch is configured to draw the blank through the central aperture of the blank support to form a cup having a sidewall and an end wall. The punch includes an aperture providing access to a cavity. The cavity has a surface area. The bottom expansion station includes a fluid source. The fluid source is configured force fluid against an area of the end wall. The area of the end wall is less than the surface area of the cavity. The fluid forces the end wall into the cavity to increase the area of the end wall.

Another embodiment of the invention relates to a method of making a metal container. The method includes cutting a metal portion from a sheet of metal at a cupping station. The method includes forming the metal portion into a cup having a sidewall and an end wall at the cupping station. The method includes holding an annular portion of the end wall surrounding a center portion of the end wall, restraining radial inward movement of metal of the held annular portion at the cupping station. The method includes increasing the surface area of the end wall by applying pressure against the center portion of the end wall.

Another embodiment of the invention relates to an expansion station. The expansion station includes an annular clamp. The annular clamp is configured to hold an outer annular portion of a metal blank surrounding a radially inner portion of the metal blank. The expansion station includes a fluid provider. The fluid provider is configured to provide fluid to apply pressure to the radially inner portion of the metal blank forming the radially inner portion into a domed portion. The annular clamp is configured to restrain metal from the outer annular portion of the metal blank from moving radially inwardly as the pressure is applied to the radially inner portion of the metal blank.

Another embodiment of the invention relates to a bottom expansion station. The bottom expansion station includes a blank support configured to support a blank. The blank support defines a central aperture. The bottom expansion station also includes a punch configured to draw the blank through the central aperture of the blank support to form a cup having a sidewall and an end wall. The punch includes an aperture. The bottom expansion station includes a pressure exertion medium configured to contact the end wall to apply pressure on a portion of the end wall to move the portion of the end wall through the aperture of the punch. The pressure exertion medium is configured to provide insubstantial tangential resistance to movement of material of the can end.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 2:
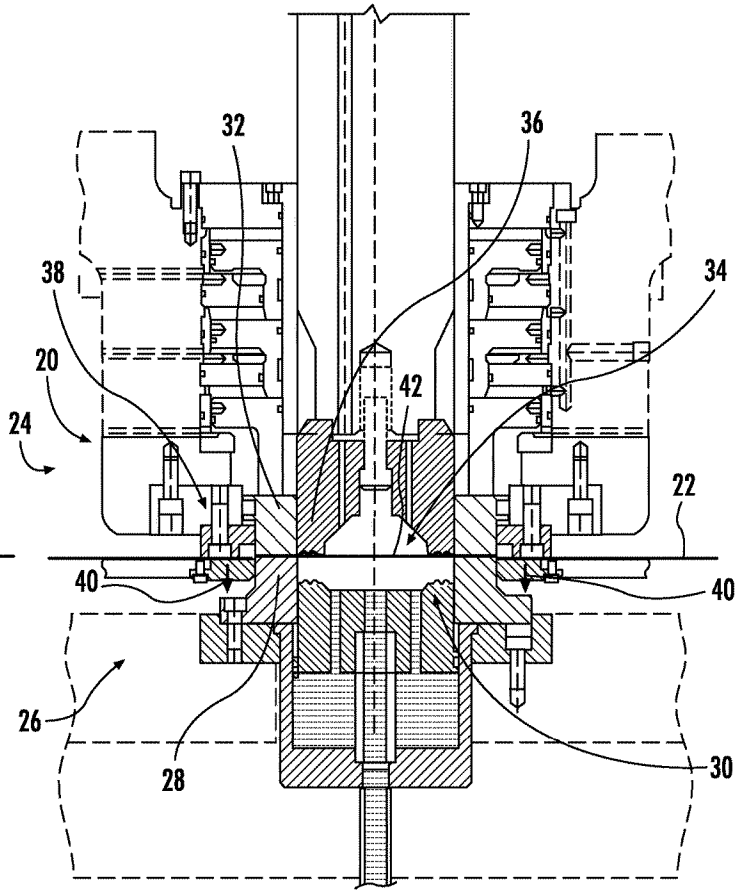
FIG. 2 is a partial cross-sectional view of an embodiment of a bottom expansion station after cutting a blank from a metal sheet.

In various embodiments, metal containers are formed by forming metal disks, e.g., blanks, into cups. The sidewalls of the cups are then stretched and extended to form a metal container, e.g., can. This process may result in a can with a sidewall that is thinner than the end wall, e.g., the end wall may have approximately the same thickness as the metal disk from which the cup was formed, while the sidewall may have a thinner thickness than the end wall. By thinning the end wall of the cup, cans with thinner end walls, e.g., more uniform thickness between the sidewall and end wall, may be created. Cans with thinner end walls will require less metal than similarly dimensioned cans with thicker, e.g., unthinned, end walls. In effect, for a given amount/volume of material, material not used in the end wall is available for use to lengthen the side wall. Accordingly, it is desirable to process a cup so that material is transferred from the end wall to the sidewalls by thinning the end wall.

Using mechanical means, e.g., solid tooling, to stretch and/or thin metal may provide resulting thinned metal with non-uniform thickness across the stretched and/or thinned portion of the metal. It may be desirable to form cups with thinned end walls that have generally uniform thickness across the thinned portion of the end walls. Cups with uniform thickness across thinned portions of end walls may be formed into containers with consistent end wall thickness, which may be desirable, e.g., localized excessive thinning of an end wall may be undesirable for a variety of reasons, for example, insufficient strength and potential breakage of the end wall.

Additionally, in various container-making facilities, space for additional machines and/or stations may be limited. Therefore, it may be desirable to provide thinning of an end wall of a cup at a single preexisting station, e.g., a cupping station, without the need to add additional stations.

In another embodiment, metal may be thinned in a separate operation, e.g., separate step, separate station, etc., than forming of a cup.

Referring generally to the figures, an embodiment of a bottom expansion station, shown as a cupping press 20, is illustrated. The press 20 is configured to cut a blank from a coil of metal, such as steel, form a cup with a sidewall and an end wall, and apply fluid pressure, e.g., liquid pressure, to the end wall of the cup to stretch and/or thin and/or expand the end wall. Applying fluid pressure provides for more consistent thinning of the end wall across the thinned portion of the end wall. A portion of the end wall may then later be drawn into the sidewall resulting in a can with a thinned end wall. Applying fluid pressure, e.g., liquid pressure, in contrast to mechanical force applied by, for example, solid tooling, allows for improved consistency of pressure application, and therefore, consistency of stretching and/or thinning and/or expanding of the thinned portion of the end wall, which may be desirable.

Figure 1:
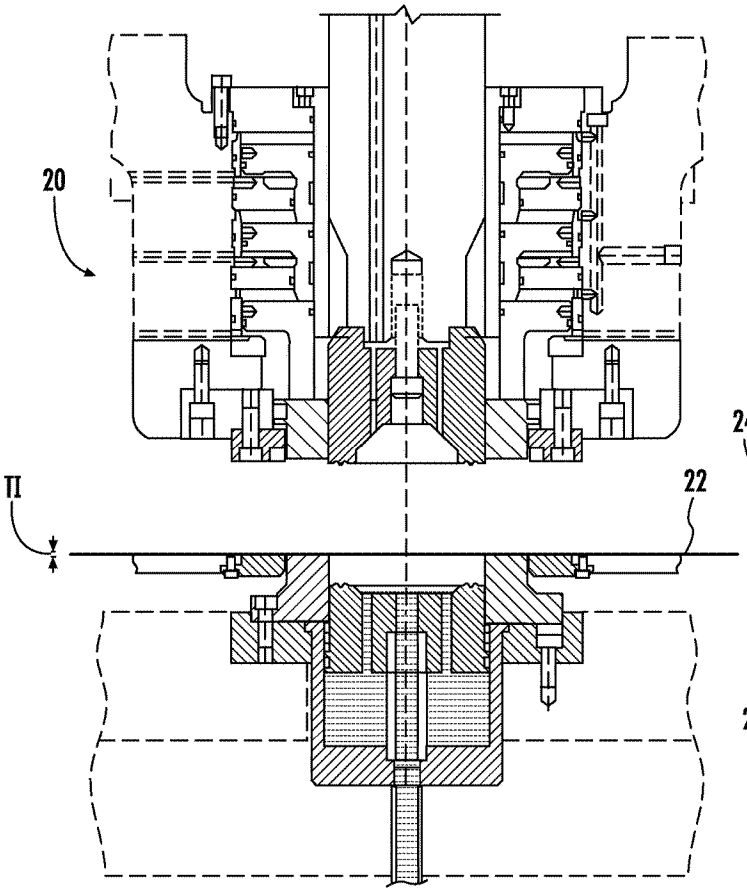
FIG. 1 is a partial cross-sectional view of an embodiment of a bottom expansion station.

With reference to FIG. 1, an embodiment of a bottom expansion station, shown as a cupping press 20, is illustrated. A metal sheet 22, for example from a coil of steel, is moved through the press 20 to provide metal from which cups will be formed. The metal sheet 22 has a thickness T1. In one embodiment, the thickness T1 is between approximately 0.01 inches and approximately 0.02 inches. In another embodiment, the thickness T1 is approximately 0.011 inches.

With reference to FIG. 2, in one embodiment, the press 20 includes an upper portion 24 and a lower portion 26. The upper portion 24 moves towards the lower portion 26 to close the cupping press 20. The lower portion 26 includes a blank support, shown as an annular blank and draw die 28, on which the metal sheet 22 is supported. The annular blank and draw die 28 defines a central bore 30. The upper portion 24 includes an annular pressure pad 32 defining a central bore 34. The upper portion 24 also includes a punch 36.

In one embodiment, the central bore 30 has an area, e.g., $\pi$ (radius of the central aperture)$^2$.

The pressure pad 32 is aligned with the annular blank and draw die 28 such that when the upper portion 24 descends, the pressure pad 32 holds the metal sheet 22 against the upper surface of the annular blank and draw die 28. With the metal sheet 22 held between the pressure pad 32 and the annular blank and draw die 28, an annular cutter, shown as cut edge 38 is displaced downwardly in the direction of arrows 40 cutting a generally circular portion, shown as blank 42, from the metal sheet 22.

In one embodiment, the punch 36 and the central bore 34 of the annular pressure pad 32 are configured to allow the punch 36 to descend through the central bore 34 to the blank 42, as illustrated in FIG. 2.

Figure 3:
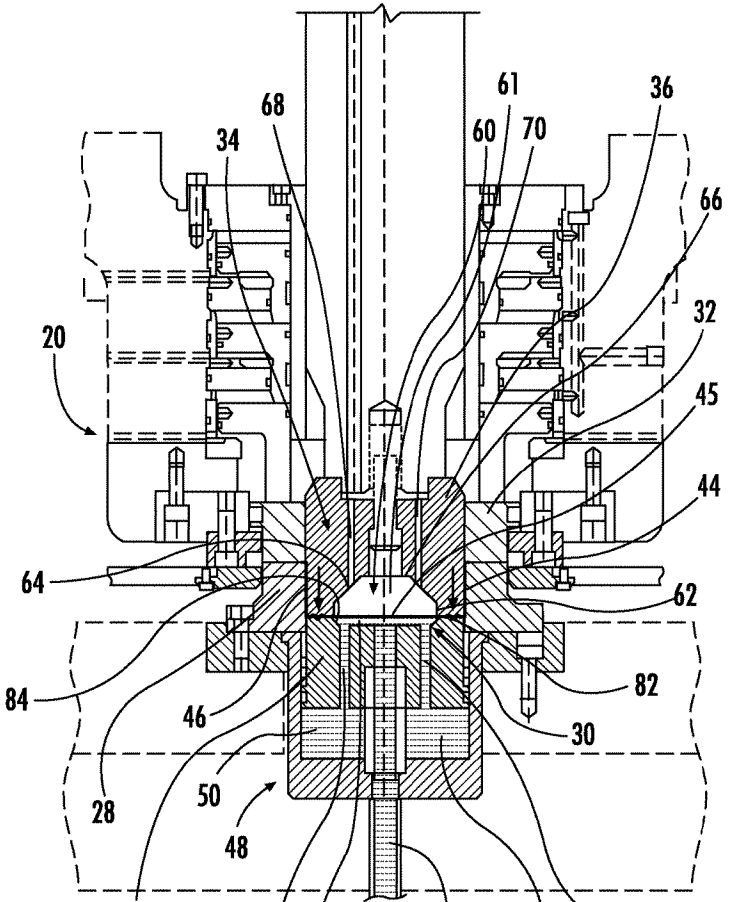
FIG. 3 is a partial cross-sectional view of an embodiment of a bottom expansion station with a punch drawing a blank through a blank and draw die to form a cup with a sidewall and an end wall.

With reference to FIGS. 2 and 3, in one embodiment, the punch 36 is moved downwardly into the central bore 30 of the annular blank and draw die 28, pressing against the center of the blank 42 and forcing the center of the blank 42 downwardly. The radially outer portion of the blank 42 is pulled from between the annular blank and draw die 28 and the annular pressure pad 32 downwardly between the surface of the annular blank and draw die 28 defining the central bore 30 and the punch 36, forming a sidewall 44 of a cup 46. The center portion moved downwardly by the punch 36 forms an end wall 45 of the cup 46.

With further reference to FIG. 3, an embodiment of a fluid provider 48 is illustrated. As will be further described below, in one embodiment, the fluid provider 48 is configured to provide fluid to the end wall 45 of the cup 46. Pressure is exerted by the fluid on the end wall 45 of the cup 46, stretching and/or thinning the end wall 45.

In one embodiment, the fluid provider 48 includes a fluid reservoir 50 and a lower member illustrated as punch pad 52. The fluid reservoir 50 is configured to hold fluid 54. The punch pad 52 is configured to move axially upwardly and downwardly in the fluid reservoir 50. Defined in the punch pad 52 is a plurality of passages, shown as two passages 56 and 58, though in other embodiments, other numbers of passages, including a single passage, may be provided. The passages 56 and 58 allow fluid 54 from the fluid reservoir 50 to pass through the punch pad 52 to the end wall 45 of the cup 46.

In one embodiment, the punch 36 has an open central portion, shown as an aperture 60 opening to a cavity 61. The aperture 60 allows a central portion of the end wall 45 of the cup 46 to deform and/or stretch and/or be forced by the fluid 54 upwardly into the cavity 61. The end wall 45 has a first area, e.g., $\pi$ (radius of the end wall)$^2$ prior to being forced into the cavity 61 and a second area, greater than the first area, after and/or when the central portion of the end wall 45 is deformed and/or stretched and/or forced by the fluid 54 into the cavity 61.

In one embodiment, the punch 36 includes a generally vertical sidewall portion 62, an angular portion 64 extending upwardly and radially inwardly from the axially upper end of the sidewall portion 62, and an upper wall portion 66 extending generally perpendicular to the sidewall portion 62 radially inwardly from the angular portion 64 defining the cavity 61.

In one embodiment, the punch 36 defines also defines vents 68 and 70. The vents 68 and 70 allow air from the cavity 61 to exit therethrough when the end wall 45 of the cup 46 is moved upwardly in the cavity 61.

In one embodiment, the sizes, locations, shapes, and relative configurations of the sidewall portion 62, angular portion 64, and upper wall portion 66 may be configured to control the resultant shape of the stretched and/or thinned portion of the end wall of cups and/or the amount that the end walls of cups are thinned. In other embodiments, cavities 61 having other shapes and/or configurations may be used to create cups with end walls with stretched and/or thinned portions of various shapes, configurations, and thicknesses, e.g., thicknesses relative to the original thickness of the metal sheet from which the blank was cut and the cup was formed. In one embodiment, the open the aperture 60 has a diameter of between approximately 1 inch and approximately 5 inches. In another embodiment, the aperture 60 has a diameter of between approximately 2 inches and approximately 3 inches. In another embodiment, the aperture 60 has a diameter of approximately 2.5 inches. In another embodiment, the aperture 60 has a diameter of approximately 2.75 inches.

In one embodiment, the fluid provider 48 includes a conduit 72 configured to provide fluid 54 to the fluid reservoir 50, e.g., to maintain the fluid level in the reservoir 50, for example, some fluid may be lost to the environment when a cupping press is opened 20 and cups are removed.

In one embodiment, the fluid 54 may be a liquid, for example, water, water and oil mixture (e.g., approximately 5% soluble oil and approximately 95% water mixture), other coolant fluid, etc. In other embodiments, other suitable fluids may be used. In one embodiment, the fluid 54 may act to cool the cup 46 and/or the press 20.

Figure 4:
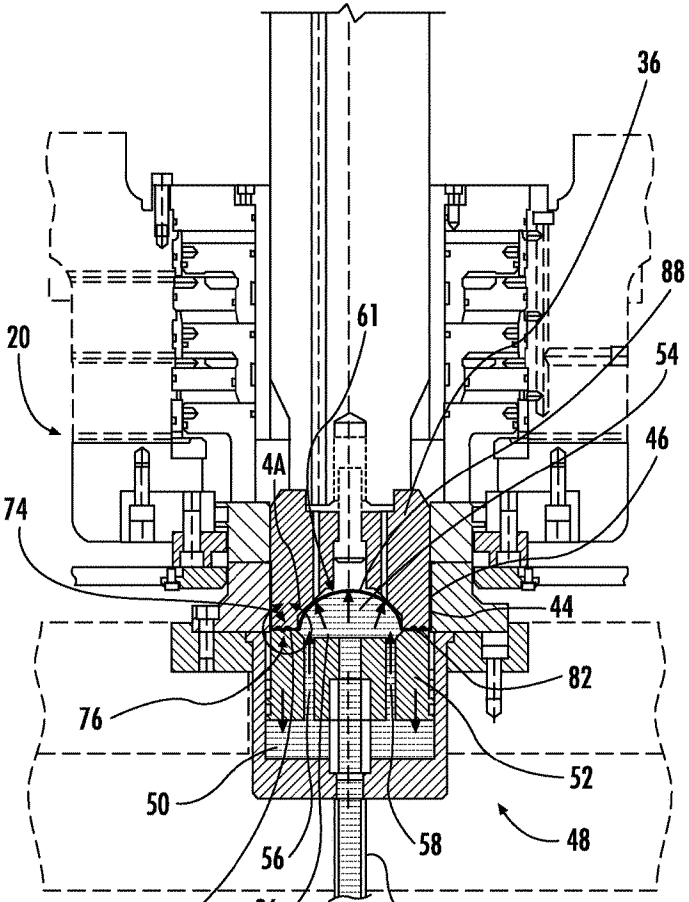
FIG. 4 is a partial cross-sectional view of an embodiment of a bottom expansion station illustrating clamping of an outer annular portion of the end wall of a cup and fluid being provided to deform the center portion of the end wall upwardly into an aperture defined by the punch to thin a portion of the end wall.
Figure 4A:
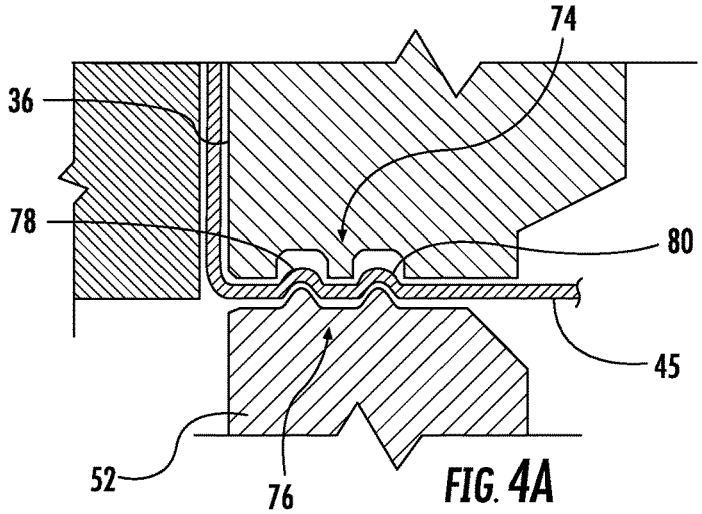
FIG. 4A is a detail view of the area 4A-4A indicated in FIG. 4.

With reference to FIG. 4, in one embodiment, the punch 36 moves the end wall 45 of the cup 46 into contact with the punch pad 52. With reference to FIGS. 4 and 4A, the punch 36 and the punch pad 52 each include mating features 74 and 76. As the punch 36 presses the end wall 45 against the punch pad 52, the mating features 74 and 76 form beads, illustrated as draw beads 78 and 80, in the end wall 45.

With further reference to FIG. 4, in one embodiment, the punch 36 continues to push the cup 46 and the punch pad 52 downwardly. As the punch pad 52 is moved downwardly into the fluid reservoir 50, fluid 54 is displaced from the fluid reservoir 50 upwardly through the passages 56 and 58 through the punch pad 52. The punch 36 and the punch pad 52 are configured to act as an annular clamp clamping a radially outer annular portion of the end wall 45 of the cup 46 surrounding a radially inner central portion of the end wall 45 to deter and/or prevent and/or restrain flow of metal from the radially outer annular portion of the end wall 45 to the radially inner central portion of the end wall 45 when fluid pressure is exerted against the radially inner central portion of the end wall 45.

With reference to FIGS. 3 and 4, in one embodiment, the punch pad 52 includes an outer annular portion 82 extending generally horizontally which is contacted by the end wall 45 and a downwardly sloping angularly extending portion 84 extending radially inwardly from the radially inner periphery of the outer annular portion 82. The portion 84 defines a pocket 86 below the end wall 45 into which fluid 54 may be introduced. The pocket 86 defines an area of the end wall 45 of the cup 46 which is contacted by fluid 54, e.g., an area against which fluid pressure is applied. In one embodiment, the surface area of the portions 62, 64, and 66 defining the cavity 61 is greater than the area of the area defined by the pocket 86.

As the punch pad 52 moves downwardly, the fluid 54 moves through the passages 56 and 58 and into the pocket 86. As the punch pad 52 continues to move into the fluid reservoir 50, fluid pressure builds up on the center portion of the end wall 45. The center portion of the end wall 45 is stretched and/or thinned and/or deformed upwardly through the aperture 60 and into the cavity 61 of the punch 36. The radial outer periphery of the end wall 45 is clamped between the punch pad 52 and the punch 36. In one embodiment, the draw beads 78 and 80 may deter and/or prevent and/or restrain metal from moving from the outer annular clamped portion of the end wall 45 into the center portion of the end wall 45 as the end wall 45 is stretched and/or thinned and moved through the aperture 60 and into the cavity 61 by the fluid 54. For example, in one embodiment, use of mating features 74 and 76 and draw beads 78 and 80 may allow for significantly reduced force to be used to clamp the radial outer periphery of the end wall 45 to deter and/or prevent and/or restrain radial inward metal flow relative to a configuration in which no mating features 74 and 76 and draw beads 78 and 80 are provided.

In one embodiment, the pressure applied to the end wall 45 by the fluid 54 is between approximately 100 psi and approximately 1000 psi. In another embodiment, the pressure applied to the end wall 45 by the fluid 54 is between approximately 300 psi and approximately 700 psi. In another embodiment, the pressure applied to the end wall 45 by the fluid 54 is approximately 500 psi. In one embodiment, the fluid 54 is applied directly to the surface of the end wall 45 of the cup 46. In another embodiment, a bladder, membrane, sheet, urethane sheet, etc., may be located between the fluid 54 and the surface of the end wall 45 of the cup 46, e.g., pressure may be applied to the end wall 45 through the bladder, membrane, sheet, urethane sheet, etc., without the fluid directing contacting the end wall 45, which may prevent, e.g., fluid loss through spillage, adhesion to the end wall 45, etc.

In one embodiment, the amount of pressure applied by the fluid 54 to the end wall 45 of the cup 46 may be controlled and/or varied based on the amount of thinning and/or stretching and/or deformation of the end wall 45 that may be desired.

In one embodiment, the amount of time that the fluid 54 applies pressure to the end wall 45 of the cup 46 may be controlled and/or varied based on the amount of thinning and/or stretching and/or deformation of the end wall 45 that may be desired. In another embodiment, both the amount of pressure applied by the fluid 54 to the end wall 45 of the cup 46 and the amount of time that the pressure is applied for can be controlled and/or varied to control the amount of thinning and/or stretching and/or deformation of the end wall 45 that may be desired.

The application of fluid pressure to the end wall 45 may provide generally even, consistent stretching and/or thinning across the central domed portion 88 of the end wall 45 of the cup 46. Additionally, application of fluid pressure to the end wall 45 may provide for stretching and/or thinning across the central domed portion 88 without wrinkling the end wall 45.

Figure 5:
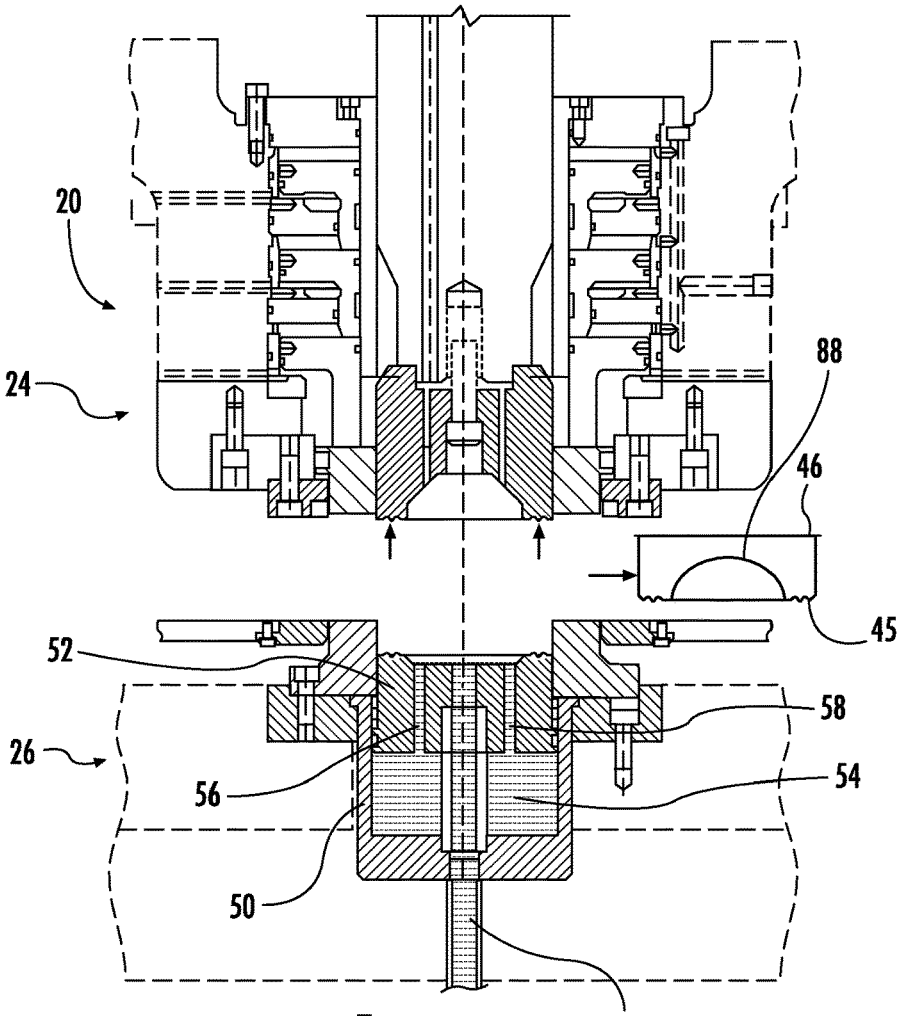
FIG. 5 is a partial cross-sectional view of an embodiment of a cup with a thinned, domed end wall portion removed from an embodiment of a bottom expansion station.

With reference to FIG. 5, the upper portion 24 of the press 20 is moved upwardly, the punch pad 52 moves upwardly and fluid 54 drains through the passages 56 and 58 to the fluid reservoir 50.

In one embodiment, the fluid pressure is controlled using a pressure relief valve controlling fluid flow through a conduit 90 in fluid communication with the fluid exerting pressure on the end wall 45. When the fluid pressure reaches a predetermined pressure level, the pressure relief valve opens and allows fluid to drain from proximate the end wall 45 out of contact with the end wall 45, through the fluid reservoir 50 and out of the bottom expansion station. In another embodiment, a cylinder, such as a two way cylinder, e.g., a hydraulic cylinder, nitrogen spring cylinder, a pneumatic cylinder, metal spring cylinder, etc., is provided. One side of the piston is in contact with the fluid applying pressure to the end wall 45 while the other side of the cylinder is supported, e.g., by nitrogen pressure, hydraulic pressure, pneumatic pressure, force from the metal spring, etc. When the fluid pressure reaches a predetermined level, the piston is displaced allowing the fluid to drain from proximate the end wall 45 out of contact with the end wall 45, through the fluid reservoir 50 and out of the bottom expansion station.

In one embodiment, the cup 46 is removed from the press 20, e.g., moved by gas directed at the cup 46 in a direction generally perpendicular to the direction of movement of the upper portion 24 of the press 20. In other embodiments, the cup 46 may be removed from the press 20 by any suitable mechanism, e.g., removed by movement of tooling, etc.

Figure 6:
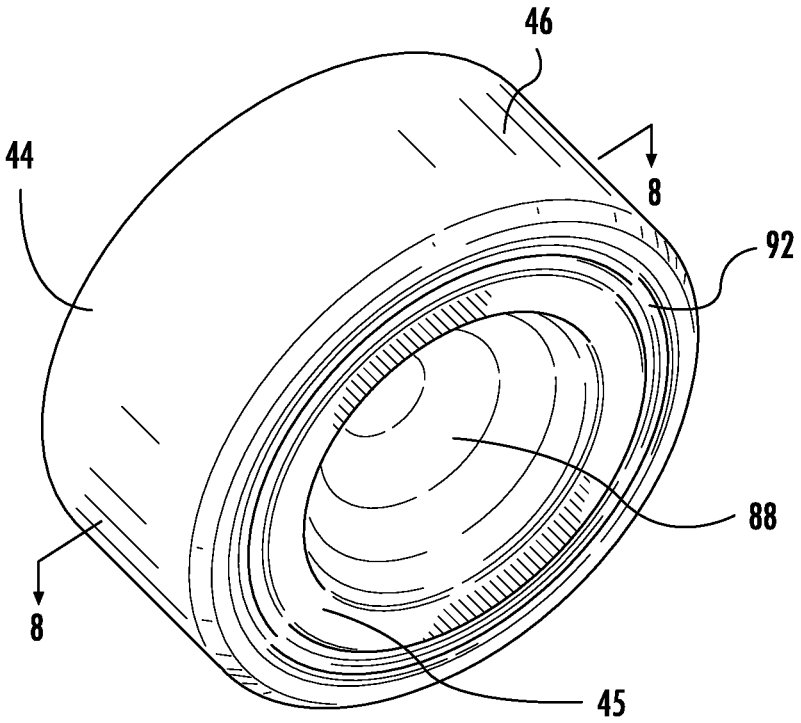
FIG. 6 is a bottom perspective view of an embodiment of a cup with a thinned, domed end wall portion.
Figure 7:
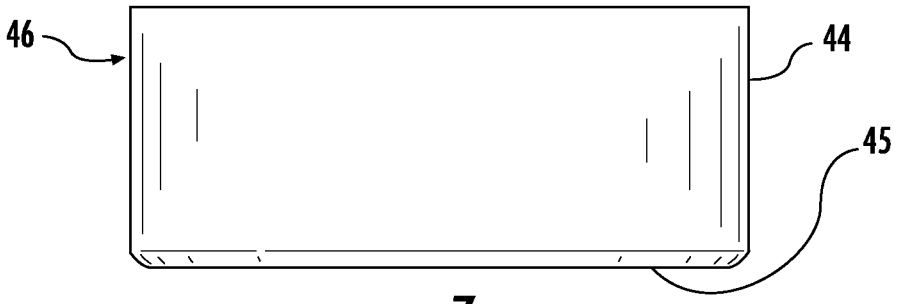
FIG. 7 is a side view of a cup with a thinned, domed end wall portion.
Figure 8:
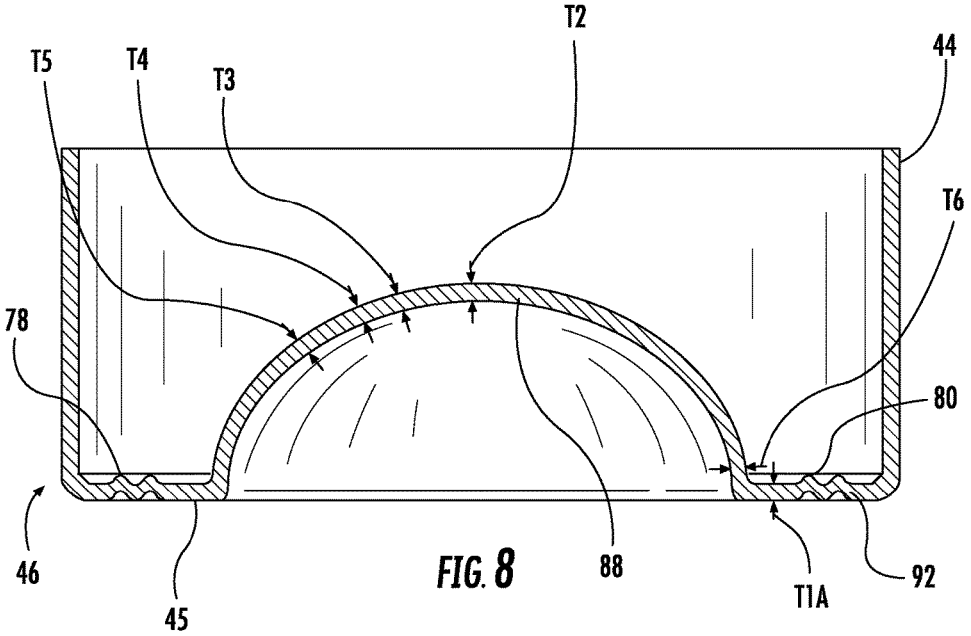
FIG. 8 is a cross-sectional view taken along the line 8-8 in FIG. 6.

With reference to FIGS. 6-8, in one embodiment, the cup 46 includes a sidewall 44 and an end wall 45. The end wall 45 includes an outer annular portion 92 that is generally unthinned and/or unstretched and the central domed portion 88 that is thinned and/or stretched. As illustrated in FIG. 8, the outer annular portion 92 generally has a thickness T1A. In one embodiment, the thickness T1A is generally the same thickness T1 as the metal sheet 22 (see FIG. 1). The domed portion 88 has a thickness T2 proximate its center and thicknesses T3, T4, T5, and T6 moving radially outwardly from the center, as illustrated in FIG. 8.

In one embodiment, thickness T2 is between approximately 50% and approximately 95% of the thickness T1. In another embodiment, the thickness T2 is between approximately 70% and approximately 80% of the thickness T1. In another embodiment, the thickness T2 is between approximately 72% and approximately 76% of the thickness T1. In another embodiment, the thickness T2 is between approximately 73% and approximately 75% of the thickness T1.

In one embodiment, the thickness T2 is between approximately 0.006 inches and approximately 0.009 inches. In another embodiment, the thickness T2 is between approximately 0.007 inches and approximately 0.0085 inches. In another embodiment, the thickness T2 is between approximately 0.0075 inches and approximately 0.0082 inches.

With further reference to FIG. 8, in one embodiment, the thicknesses T3, T4, and T5, each differ from the thickness T2 by less than approximately 35%. In another embodiment, the thicknesses T3, T4, and T5 each differ from the thickness T2 by less than approximately 25%. In another embodiment, the thicknesses T3, T4, and T5 each differ from the thickness T2 by less than approximately 15%. In another embodiment, the thicknesses T3, T4, and T5 each differ from the thickness T2 by less than approximately 10%. In another embodiment, the thicknesses T3, T4, and T5 each differ from the thickness T2 by less than approximately 5%.

With further reference to FIG. 8, in one embodiment, the thickness T6 differs from thicknesses T2-T5 by less than approximately 35%. In another embodiment, the thickness T6 differs from the thicknesses T2-T5 by less than approximately 25%. In another embodiment, the thickness T6 differs from the thicknesses T2-T5 by less than approximately 15%. In another embodiment, the thickness T6 differs from the thicknesses T2-T5 by less than approximately 10%. In another embodiment, the thickness T6 differs from the thicknesses T2-T5 by less than approximately 5%.

Application of fluid pressure to the end wall 45 of the cup 46 to form the domed portion 88 may provide for relatively consistent thicknesses across the domed portion 88, e.g., T2, T3, T4, and T5 being relatively consistent. In one embodiment, application of fluid pressure to the end wall 45 of the cup 46 to form the domed portion 88 may provide for relatively consistent thicknesses across the domed portion 88, e.g., T2, T3, T4, T5, and T6 being relatively consistent.

With reference to FIGS. 9-15A, an embodiment of a process for forming a cup with a thinned and/or stretched and/or domed end wall portion into a container, e.g., a finished container or finished can is described.

Figure 9:
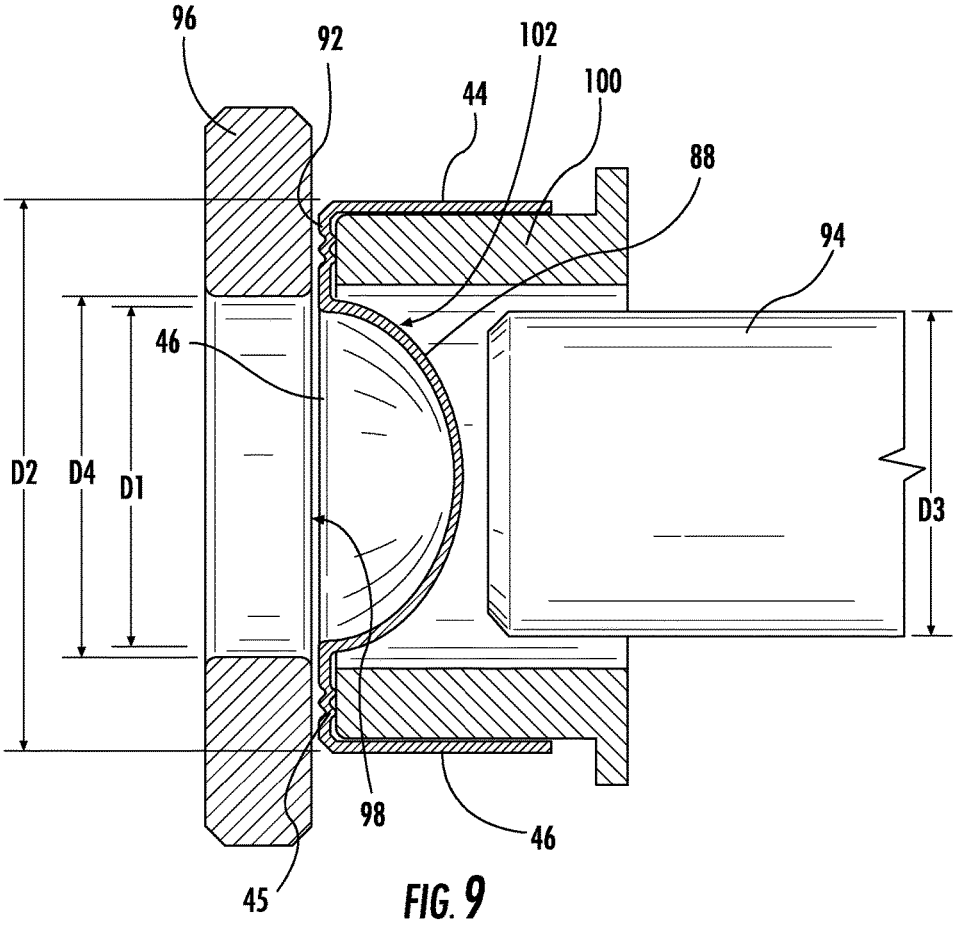
FIG. 9 is a cross-sectional view of an embodiment of a cup with a thinned, domed end wall portion, a die with a central aperture, and a punch.

As illustrated in FIG. 9, the domed portion 88 of the end wall 45 has a diameter D1. The end wall 45 of the cup 46 has a diameter D2. A punch 94 has a diameter D3. A die 96 including a central aperture 98 is also provided. The central aperture 98 has a diameter D4. In one embodiment, the diameter D1 is generally the same as the diameter D3 of the punch 94. In another embodiment, the diameter D1 is less than the diameter D3 of the punch 94. In one embodiment, the diameter D2 of the end wall 45 of the cup 46 is greater than the diameter D4 of the central aperture 98.

Figure 10:
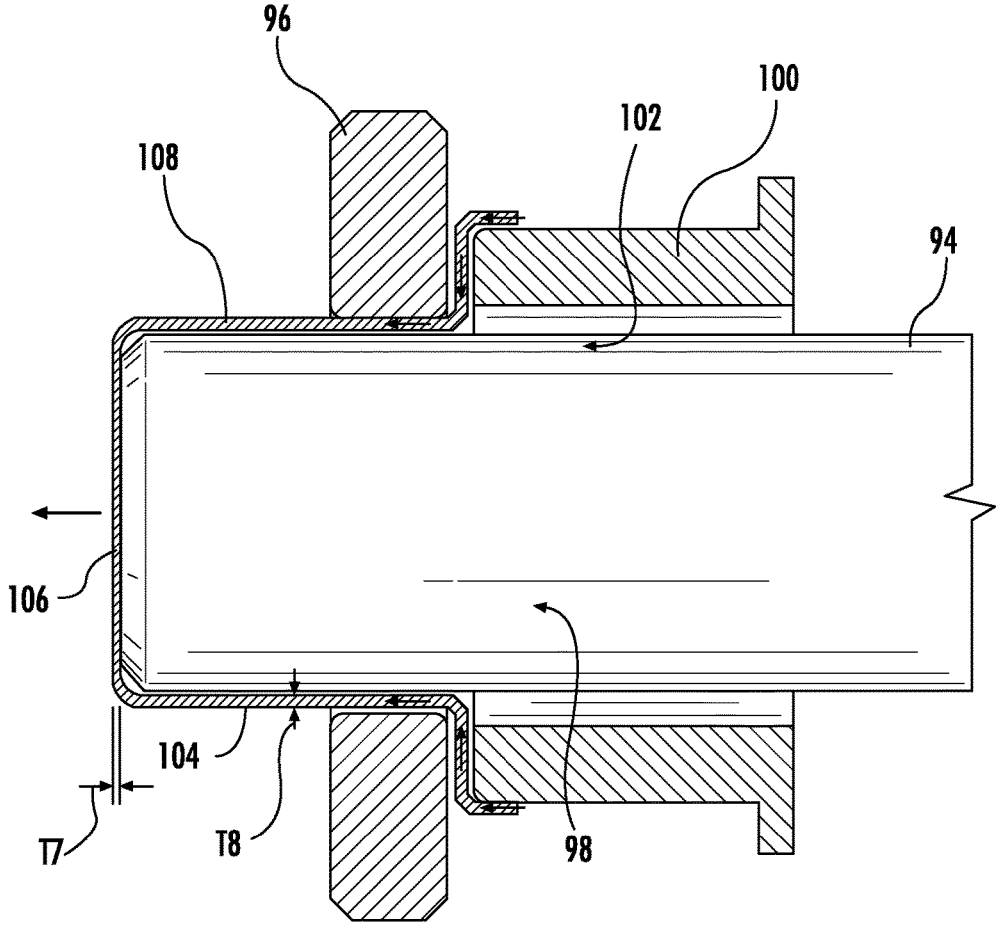
FIG. 10 illustrates the cup of FIG. 9 being drawn through the central aperture of the die by the punch to form an embodiment of an elongated cup.

The cup 46 is located proximate the die 96. An annular holding portion 100 with a central aperture 102 is inserted into the cup 46. The cup 46 is located with the end wall 45 covering the central aperture 98 of the die 96. The punch 94 moves through the central aperture 102 of the holding portion 100 and contacts the domed portion 88 of the end wall 45 of the cup 46. With reference to FIGS. 9 and 10, the radially outer portion of the end wall is moved into the sidewall to become part of the sidewall to form a elongated cup 104 including a thinned end wall 106 and a sidewall 108. In one embodiment, the height of the sidewall 108 of the elongated cup 104 will be greater than the height of the sidewall of the cup 46 because a portion of the end wall of the cup 46 is moved into the sidewall to form the elongated cup 104. The end wall 106 of the elongated cup 104 has a thickness T7 that is less than the thickness of the sidewall 108 of the elongated cup 104.

Figure 11:
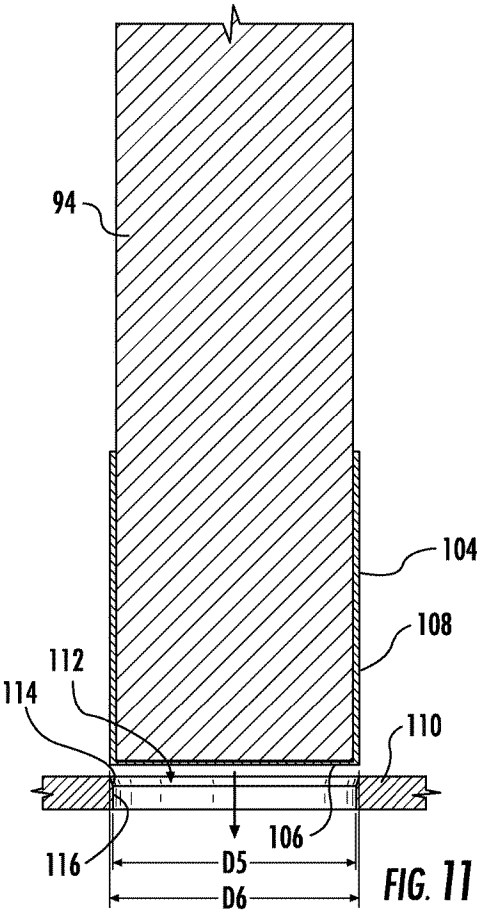
FIG. 11 is a cross-sectional view of the elongated cup after being drawn through the central aperture of the die illustrated in FIG. 10 with a second die with a central aperture and a punch.

With reference to FIG. 11, the elongated cup 104 then undergoes a further process, illustrated in FIG. 11 as an ironing process. In the ironing process, in one embodiment, a second die 110 is provided. The second die 110 includes a central aperture 112. The surface of the second die 110 defining the central aperture 112 includes an upper chamfered portion 114 and a lower portion 116. The portion of the central aperture 112 defined by the lower portion 116 has a diameter D5. The diameter D5 is less than the outer diameter D6 of the elongated metal cup 104.

Figure 12A:
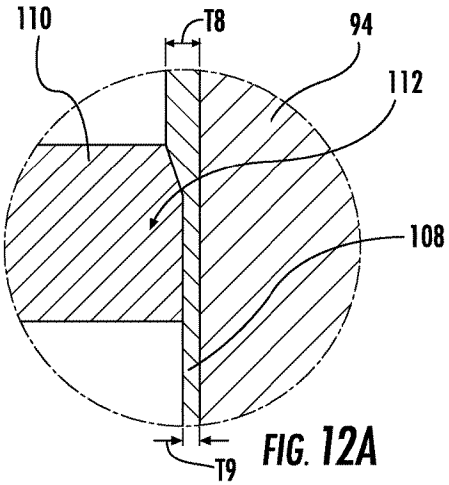
FIG. 12A is a detail view of the area 12A in FIG. 12.
Figure 12:
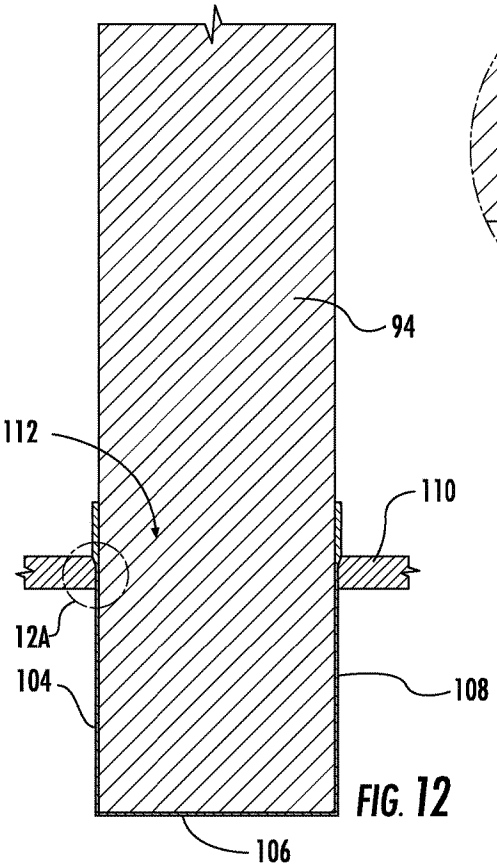
FIG. 12 illustrates ironing of the sidewalls of the container of FIG. 11.

With further reference to FIGS. 11-12A, in one embodiment, the punch 94 (in other embodiments a different punch may be used from the punch 94 shown in FIG. 10 used to form the elongated cup 104) displaces the elongated cup 104 through the central aperture 112 of the second die 110. As the sidewall 108 is moved through the central aperture 112, the lower portion 116 and the punch 94 cause the sidewall 104 to elongate and/or stretch and/or thin to allow the sidewall 108 to pass through the central aperture 112 and causing the length of the sidewall 108 to be increased (e.g., the lower portion 116 and the outer surface of the punch 94 are arranged a radial distance apart less than the thickness of the sidewall 108).

With reference to FIG. 12A, a detail view of the sidewall 108 passing through the central aperture 112 of the second die 110 is illustrated. In one embodiment, the sidewall 108 has a thickness T8 prior to passing through the central aperture 112 of the second die 110. In one embodiment, the sidewall 108 has a thickness T9 upon passing through the central aperture 112 of the second die 112. In one embodiment the thickness T9 is less than the thickness T8.

In one embodiment, the thickness T8 is between approximately 0.005 inches and approximately 0.015 inches. In another embodiment, the thickness T8 is between approximately 0.007 inches and approximately 0.013 inches. In another embodiment, the thickness T8 is approximately 0.011 inches.

In one embodiment, the thickness T9 is between approximately 0.002 inches and approximately 0.01 inches. In another embodiment, the thickness T9 is between approximately 0.003 inches and approximately 0.007 inches. In another embodiment, the thickness T9 is approximately 0.006 inches.

Figure 13:
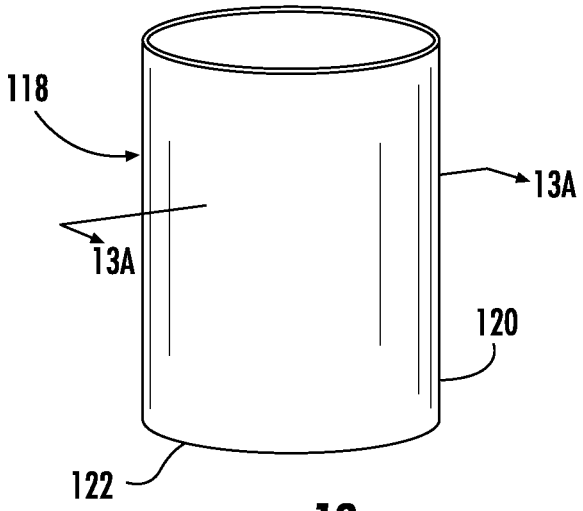
FIG. 13 is a perspective view of an embodiment of a preform with a thinned end wall and ironed sidewall.
Figure 13A:
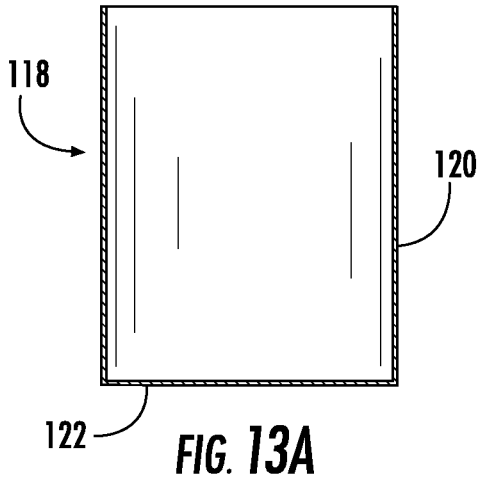
FIG. 13A is a cross-sectional view taken along the line 13A-13A in FIG. 13.

The ironing process illustrated in FIGS. 11-12A forms the elongated cup 104 into a preform 118 having a thinned sidewall 120 and a thinned end wall 122, as illustrated in FIGS. 13 and 13A. In one embodiment, the thickness of the end wall 122 is between approximately 0.006 inches and approximately 0.009 inches. In another embodiment, the thickness of the end wall 122 is between approximately 0.0075 inches and approximately 0.0085 inches. In another embodiment, the thickness of the end wall 122 is between approximately 0.008 inches and approximately 0.0082 inches.

Figure 14:
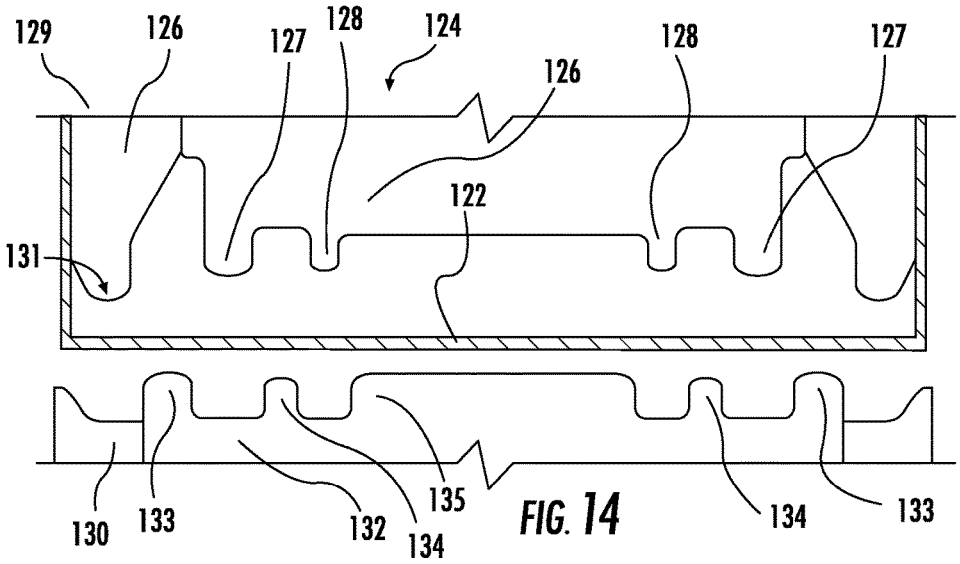
FIG. 14 is a cross-sectional view of the preform of FIG. 13A with a beading apparatus configured to bead the end wall of the preform.
Figure 14A:
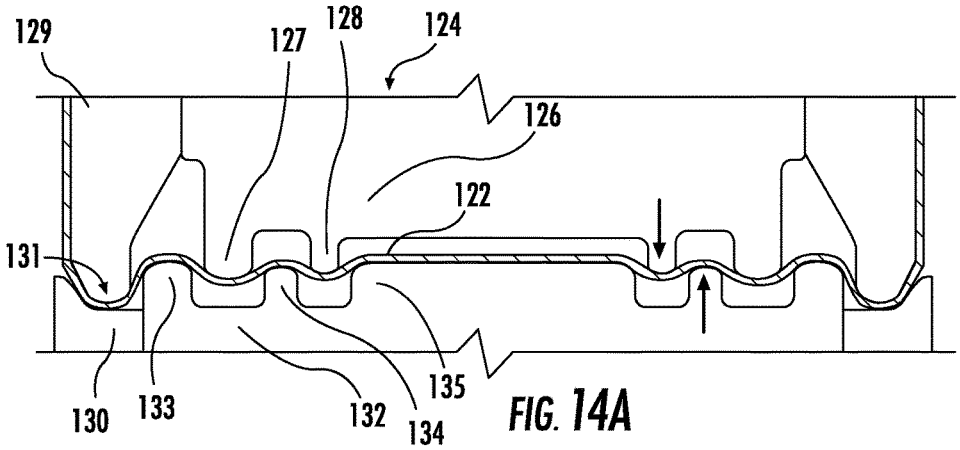
FIG. 14A illustrates the beading apparatus of FIG. 14 beading the end wall of a preform.
Figure 15:
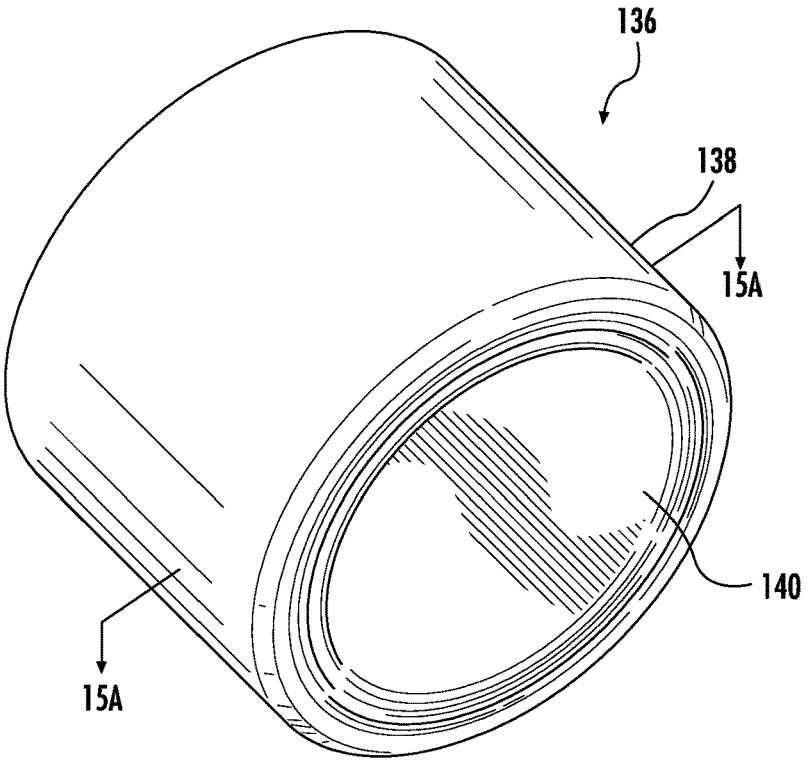
FIG. 15 is a perspective view of an embodiment of a finished container with a thinned end wall and an ironed sidewall.
Figure 15A:
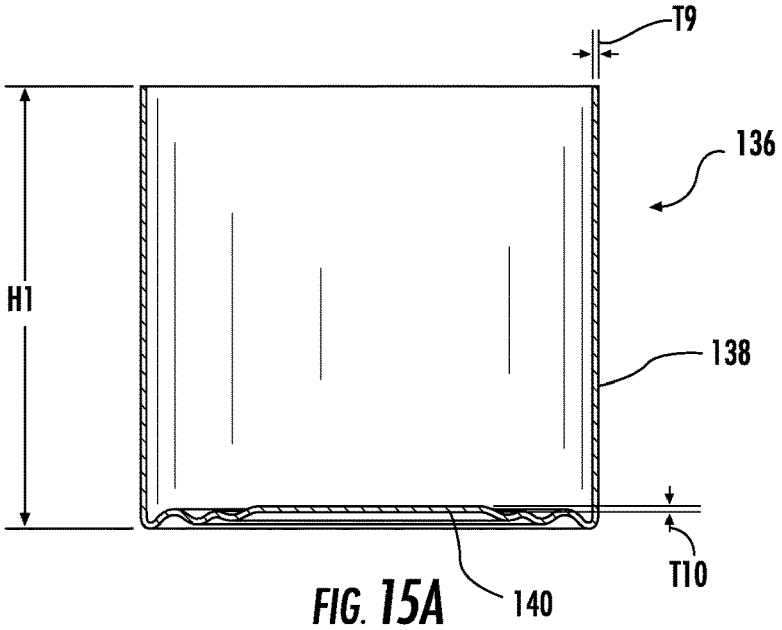
FIG. 15A is cross-sectional view taken along the line 15A-15A in FIG. 15.

With reference to FIGS. 14-15A, the thinned end wall 122 of the preform 118 undergoes a beading process to form a finished can. In one embodiment, a bottom profiling assembly 124 is provided. The assembly 124 includes a punch insert 126 including a pair of downwardly projecting beading features 127 and 128. The assembly 124 also includes an outer annular punch sleeve 129 and an outer annular clamp ring 130. The outer portion of the end wall is clamped between the punch sleeve 129 and the clamp ring 130 which are configured to mate and form a peripheral countersink 131 in the end wall 122. The assembly 124 also includes a domer pad 132 including a plurality of upwardly projecting beading features 133, 134, and 135. The beading features 127 and 128 of the punch insert 126 are configured to mate with the beading features 133, 134, and 135 of the domer pad 132 to form beads in the thinned end wall.

In one embodiment, this results in a finished can 136 with a sidewall 138 and a beaded, thinned end wall 140, as illustrated in FIGS. 15 and 15A. In other embodiments, any other suitable method to provide beads and a countersink in the thinned end wall 138 may be used.

With further reference to FIG. 15A, in one embodiment, the sidewall 136 has a thickness T9. In one embodiment, the thickness T9 is between approximately 0.003 inches and approximately 0.007 inches. In another embodiment, the thickness T9 is between approximately 0.004 inches and approximately 0.006 inches. In another embodiment, the thickness T9 is approximately 0.005 inches.

With further reference to FIG. 15A, in one embodiment, the end wall 138 has a thickness T10. In one embodiment, the thickness T10 is between approximately 0.003 inches and approximately 0.007 inches. In another embodiment, the thickness T10 is between approximately 0.004 inches and approximately 0.006 inches. In another embodiment, the thickness T10 is approximately 0.005 inches. In one embodiment, the thickness T10 is between approximately 90% and approximately 150% of the thickness of the thickness T9. In another embodiment, the thickness T10 is between approximately 95% and approximately 120% of the thickness T9. In another embodiment, the thickness T10 is between approximately 95% and approximately 100% of the thickness T9.

The sidewall 136 has a height H1. In one embodiment, the height H1 is between approximately 1 inch and approximately 15 inches. In another embodiment, the height H1 is between approximately 3 inches and approximately 8 inches. In another embodiment, the height H1 is approximately 4 inches.

A finished can 134 with a thinned end wall 138 may have the same height H1 as a can with formed with a thicker end wall, e.g., an un-thinned end wall, while requiring use of less metal, e.g., a smaller blank 42 see FIG. 2.

In another embodiment, pressure is exerted onto a portion of the end wall of a cup through a pressure exertion medium to stretch and/or thin and/or deform and/or increase the area of the end wall. In one embodiment, the pressure exertion medium is a fluid (e.g., water, mixture of water and oil, etc.). In another embodiment, the pressure exertion medium is a solid (e.g., urethane, polyurethane, plastic, rubber, artificial rubber, etc.). In one embodiment, the pressure exertion medium deforms and/or changes shape when pressure is applied through it to the end wall of the cup, e.g., the pressure exertion medium is deformable by the end wall of the cup when pressure is applied through it to the end wall of the cup.

In one embodiment, force is exerted on the portion of the end wall to stretch the portion of the end wall to the desired shape and/or dimensions. As force is exerted, there is a resistance, e.g., a force per distance, to sliding movement of the end wall tangentially over the force exertion medium. An amount of force will overcome the resistance between the portion of the end wall and the pressure exertion medium to tangentially slide the end wall over the pressure exertion medium.

A property of the material of the pressure exertion medium is the amount of force that will deform (e.g., change the shape of) the material in a shear mode (e.g., generally in parallel to the surface of the pressure exertion medium, etc.).

In one embodiment, the material of the pressure exertion medium is such that the amount of force that will deform the material in a shear mode is less than and/or low relative to the amount of friction force to overcome to slide the portion of the end wall relative to the surface of the pressure exertion medium.

In one embodiment, the material of the pressure exertion medium is such that the amount of force to deform the material in a shear mode is at least 25% less than the amount of force to slide the end wall relative to the surface of the pressure exertion medium. In another embodiment, the material of the pressure exertion medium is such that the amount of force to deform the material in a shear mode is at least 50% less than the amount of force to slide the end wall relative to the surface of the pressure exertion medium. In another embodiment, the material of the pressure exertion medium is such that the amount of force to deform the material in a shear mode is at least 75% less than the amount of force to slide the end wall relative to the surface of the pressure exertion medium. In another embodiment, the material of the pressure exertion medium is such that the amount of force to deform the material in a shear mode is at least 95% less than the amount of force to slide the end wall relative to the surface of the pressure exertion medium.

In one embodiment, the pressure exertion medium includes a portion of urethane. The amount of force to deform the portion of urethane in a shear mode is less than and/or low relative to the amount of force to slide the portion of the end wall over the portion of urethane.

In another embodiment, the pressure exertion medium is configured to contact the end wall of a cup to apply pressure on a portion of the end wall. The pressure exertion medium is configured to provide insubstantial tangential resistance to movement of material of the can end, e.g., provide low resistance to the end wall sliding over or relative to the pressure exertion medium. In one embodiment, water is one example of a pressure exertion medium that is configured to provide insubstantial tangential resistance to movement of material of the can end. In another embodiment, oil is another example of a pressure exertion medium that is configured to provide insubstantial tangential resistance to movement of material of the can end. In another embodiment, a water and oil mixture is another example of a pressure exertion medium that is configured to provide insubstantial tangential resistance to movement of material of the can end.

In one embodiment, the pressure exertion medium is also compressible. In one embodiment, the pressure exertion medium has a bulk modulus of less than $100\times10^9$ N/m$^2$ at atmospheric pressure (e.g., approximately 1 atmosphere, approximately 760 mmHg, etc.) and at approximately 70° F. In another embodiment, the pressure exertion medium has a bulk modulus of less than $50\times10^9$ N/m$^2$ at atmospheric pressure and at approximately 70° F. In another embodiment, the pressure exertion medium has a bulk modulus of less than $5\times10^9$ N/m$^2$ at atmospheric pressure and at approximately 70° F. In another embodiment, the pressure exertion medium has a bulk modulus of approximately $2.2\times10^9$ N/m$^2$ at atmospheric pressure and at approximately 70° F.

In one embodiment, the pressure exertion medium is a material the volume of which decreases by more than 1% under $4\times10^7$ N/m$^2$ of pressure at a constant temperature, e.g., approximately 70° F. In another embodiment, the pressure exertion medium is a material the volume of the material decreases by more than 0.5% under $4\times10^7$ N/m$^2$ of pressure at a constant temperature, e.g., approximately 70° F. In another embodiment, the pressure exertion medium is a material the volume of the material decreases by more than 0.1% under $4\times10^7$ N/m$^2$ of pressure at a constant temperature, e.g., approximately 70° F.

In one embodiment, an end wall of a cup has an outer annular area which is clamped and an inner area having a surface area. The pressure exertion medium is configured to apply pressure, both at the time of initiation of applying pressure and throughout application of pressure, to stretch the inner area of the end wall generally evenly. In one embodiment, the area to which the pressure exertion medium is configured to apply pressure generally evenly to generally at initiation of pressure application is between approximately 25% of the surface area of the inner area and approximately 100% of the inner area. In another embodiment, the area to which the pressure exertion medium is configured to apply pressure generally evenly to generally at initiation of pressure application is between approximately 50% of the surface area of the inner area and approximately 100% of the inner area. In another embodiment, the area to which the pressure exertion medium is configured to apply pressure generally evenly to generally at initiation of pressure application is between approximately 50% of the surface area of the inner area and approximately 100% of the inner area.

While the embodiment of a cupping press 20 described above is shown forming a single cup with each stroke, e.g., a movement of the upper portion 24 of the press 20 downwardly and a downward movement of the punch 36, this is merely exemplary. In other embodiments, cupping presses may form multiple cups with thinned, stretched, and/or domed end wall with each stroke.

In one embodiment, cups such as those described above may be formed into finished containers by draw and iron processes, draw and redraw processes, or any other suitable process.

In another embodiment, a portion of a sheet of metal may be domed, and/or stretched, and/or thinned, e.g., by application of pressure, e.g., fluid pressure, liquid pressure, urethane pressure, etc., to a portion of the sheet of metal prior to the portion of the sheet of metal being formed into a cup, with the domed and/or stretched and/or thinned portion becoming a portion of the end wall of the cup. This cup with the domed and/or stretched and/or thinned end wall may be further processed into a container in accordance with the steps described above.

In another embodiment, a block of material, e.g., urethane, may be provided in an embodiment of a bottom expansion station. Pressure is applied to the end wall via the block of material, e.g., the urethane block, to dome and/or stretch and/or thin the end wall of the cup. This cup with the domed and/or stretched and/or thinned end wall may be further processed into a container in accordance with the steps described above.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

According to exemplary embodiments, the finished containers, e.g., cans, discussed herein are formed from metal, and specifically may be formed from, stainless steel, tin-coated steel, aluminum, etc. In some embodiments, the finished containers, e.g., cans, discussed herein are formed from aluminum. In other embodiments, the finished containers, e.g., cans discussed herein are formed from interstitial-free ("IF") steel. In some embodiments, the cans may be formed from other metals or materials.

Cans discussed herein may include containers of any style, shape, size, etc. For example, the cans discussed herein may be shaped such that cross-sections taken perpendicular to the longitudinal axis of the cans are generally circular. However, in other embodiments the sidewall of the cans discussed herein may be shaped in a variety of ways (e.g., having other non-polygonal cross-sections, as a rectangular prism, a polygonal prism, any number of irregular shapes, etc.) as may be desirable for different applications or aesthetic reasons. In various embodiments, the sidewall of a can may include one or more axially extending sidewall sections that are curved radially inwardly or outwardly such that the diameter of the can is different at different places along the axial length of the can, and such curved sections may be smooth continuous curved sections. In one embodiment, cans may be hourglass shaped. Cans may be of various sizes (e.g., 3 oz., 8 oz., 12 oz., 15 oz., 28 oz, etc.) as desired for a particular application.

In various embodiments, trimmed sidewalls of cans may be coupled to a closure, such as a can end, to close the can, e.g., in one embodiment, by a "double seam" formed from the interlocked portions of material of the can sidewall and the can end. However, in other embodiments, the can ends discussed herein may be coupled to the sidewall via other mechanisms. For example, can ends may be coupled to the sidewall via welds or solders.

The containers discussed herein may be used to hold perishable materials (e.g., food, drink, pet food, milk-based products, etc.). It should be understood that the phrase "food" used to describe various embodiments of this disclosure may refer to dry food, moist food, powder, liquid, or any other drinkable or edible material, regardless of nutritional value. In other embodiments, the containers discussed herein may be used to hold non-perishable materials or non-food materials. In various embodiments, the containers discussed herein may contain a product that is packed in liquid that is drained from the product prior to use. For example, the containers discussed herein may contain vegetables, pasta or meats packed in a liquid such as water, brine, or oil.

According to various exemplary embodiments, the inner surfaces of the cans may include a liner (e.g., an insert, coating, lining, a protective coating, sealant, etc.). The protective coating acts to protect the material of the can from degradation that may be caused by the contents of the can. In an exemplary embodiment, the protective coating may be a coating that may be applied via spraying or any other suitable method. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, EVOH and/or other suitable lining material or spray. The interior surfaces of the container ends may also be coated with a protective coating as described above.

What is claimed is:

1. A bottom expansion station comprising:

a blank support configured to support a metal blank, the blank support defining a central aperture having an aperture area;

a punch configured to draw the blank through the central aperture of the blank support to form a cup having a sidewall and an end wall, the punch including an aperture providing access to a cavity, the cavity having a surface area; and a fluid source configured to force fluid against an area of the end wall, the area of the end wall being less than the surface area of the cavity, the fluid forcing the end wall into the cavity to increase the area of the end wall.

2. The bottom expansion station of claim 1, further comprising a lower member aligned with the central aperture of the blank support.

3. The bottom expansion station of claim 2, wherein the lower member and the punch are configured to hold an outer annular portion of the end wall therebetween to deter metal flow from the outer annular portion of the end wall into a central portion of the end wall as the area of the end wall is increased.

4. The bottom expansion station of claim 2, wherein the lower member defines a plurality of apertures through which the fluid is provided to the end wall.

5. The bottom expansion station of claim 1, wherein the fluid includes water and oil.

6. The bottom expansion station of claim 5, wherein the punch includes annular sidewalls defining the cavity.

7. The bottom expansion station of claim 6, wherein the punch includes a top wall portion, the top wall defining a plurality of vents, the top wall portion generally providing a closed end of the cavity.

8. The bottom expansion station of claim 1, wherein the punch provides a first mating feature and the lower member provides a second mating feature, the mating features being configured to form beads in the end wall.

9. The bottom expansion station of claim 1, further comprising a cutter configured to remove the blank from a metal sheet.

10. A method of making a metal container comprising:

cutting a metal portion from a sheet of metal at a cupping station;

forming the metal portion into a cup having a sidewall and an end wall at the cupping station;

holding an annular portion of the end wall surrounding a center portion of the end wall, restraining radial inward movement of metal of the held annular portion at the cupping station; and increasing the surface area of the end wall by applying fluid pressure against the center portion of the end wall; and wherein the steps are performed in a single stroke of a punch of the cupping station.

11. An expansion station comprising:

an annular clamp configured to hold an outer annular portion of a metal blank surrounding a radially inner portion of the metal blank;

a fluid provider configured to provide fluid to apply pressure to the radially inner portion of the metal blank forming the radially inner portion into a domed portion, wherein the annular clamp is configured to restrain metal from the outer annular portion of the metal blank from moving radially inwardly as the pressure is applied to the radially inner portion of the metal blank; and a punch configured to form the metal blank into a cup having a sidewall and an end wall wherein the punch defines a central aperture configured to allow entrance of the domed portion.

* * * * *